US009302289B2

(12) United States Patent
Thompson et al.

(10) Patent No.: US 9,302,289 B2
(45) Date of Patent: Apr. 5, 2016

(54) DISPENSING DEVICES FOR USE WITH SIDE-BY-SIDE FLUID CARTRIDGES AND RELATED METHODS

(71) Applicant: Nordson Corporation, Westlake, OH (US)

(72) Inventors: Jeff Thompson, N. Smithfield, RI (US); Peter J. Wong, Millbury, MA (US)

(73) Assignee: NORDSON CORPORATION, Westlake, OH (US)

( * ) Notice: Subject to any disclaimer, the term of this patent is extended or adjusted under 35 U.S.C. 154(b) by 88 days.

(21) Appl. No.: 14/196,486

(22) Filed: Mar. 4, 2014

(65) Prior Publication Data

US 2015/0251209 A1 Sep. 10, 2015

(51) Int. Cl.

| | |
|---|---|
| ***B67D 7/70*** | (2010.01) |
| ***B05C 17/005*** | (2006.01) |
| ***B05C 17/015*** | (2006.01) |

(52) U.S. Cl.

CPC ..... *B05C 17/00559* (2013.01); *B05C 17/00553* (2013.01); *B05C 17/015* (2013.01); *B05C 17/00596* (2013.01); *Y10T 29/49826* (2015.01)

(58) Field of Classification Search

CPC ..... B65C 17/00559; B65C 17/00596; B65C 17/015; B65C 17/00543; B65C 17/00556; B65C 17/00553; Y10T 29/49826

USPC ..... 222/135–142, 386, 389, 394, 391, 401, 222/402, 325–328, 94, 65, 145.1, 145.5, 222/145.6, 153.09

See application file for complete search history.

(56) References Cited

U.S. PATENT DOCUMENTS

| | | | | |
|---|---|---|---|---|
| 3,076,225 | A | 2/1963 | Sherbondy | |
| 4,090,639 | A | 5/1978 | Campbell et al. | |
| 5,005,735 | A * | 4/1991 | Keller | 222/137 |

(Continued)

FOREIGN PATENT DOCUMENTS

| | | | |
|---|---|---|---|
| EP | 2292193 | A2 | 3/2011 |
| WO | 02060600 | A1 | 8/2002 |
| WO | 2007146921 | A2 | 12/2007 |

OTHER PUBLICATIONS

Nordson Corporation, Equalizer™ Nordson EFD Equalizer™ Operating Manual, 4 pgs., 2011.

(Continued)

*Primary Examiner* — Lien Ngo
(74) *Attorney, Agent, or Firm* — Baker & Hostetler LLP

(57) ABSTRACT

A dispensing device for dispensing fluid from a side-by-side fluid cartridge includes a dispenser body, a first piston adapted to slide within a first fluid chamber of the fluid cartridge, a second piston adapted to slide within a second fluid chamber of the fluid cartridge, and an adapter head moveable between first and second positions for releasably connecting the fluid cartridge to the dispenser body. The first piston and the second piston are coaxially aligned with the first fluid chamber and the second fluid chamber, respectively, when the adapter head is in the first position and also when the adapter head is in the second position. Another dispensing device includes a plate coupled with a dispenser body and movable in an axial direction of a fluid cartridge between a first position for receiving a first cartridge flange having a first flange thickness and a second position for receiving a second cartridge flange having a second flange thickness.

17 Claims, 8 Drawing Sheets

(56) References Cited

U.S. PATENT DOCUMENTS

| | | | | |
|---|---|---|---|---|
| 5,336,014 | A * | 8/1994 | Keller | 403/24 |
| 2008/0197154 | A1 | 8/2008 | Herman et al. | |
| 2013/0087578 | A1 | 4/2013 | Brem et al. | |
| 2013/0161353 | A1 * | 6/2013 | Baldelli | 222/137 |
| 2015/0048115 | A1 * | 2/2015 | Hung | 222/143 |

OTHER PUBLICATIONS

European Patent Office, European Search Report in EP Application No. 15156809, Jul. 24, 2015.

* cited by examiner

DISPENSING DEVICES FOR USE WITH SIDE-BY-SIDE FLUID CARTRIDGES AND RELATED METHODS

TECHNICAL FIELD

The present invention relates generally to fluid dispensing devices. More particularly, the invention relates to dispensing devices for dispensing fluid from side-by-side fluid cartridges and related methods of connecting side-by-side fluid cartridges to dispensing devices.

BACKGROUND

Side-by-side fluid cartridges (also known as dual-compartment cartridges or multi-component cartridges) are used for storing two viscous fluids separately within a single container unit and dispensing the fluids simultaneously so that they may be mixed and applied to a common substrate. Traditional side-by-side cartridges consist of a pair of cylindrically-shaped fluid chambers positioned adjacent and parallel to one another. Each chamber is configured to store a viscous fluid and includes an inlet at which the chamber is filled with the fluid, and an outlet from which the fluid is later dispensed. For example, the side-by-side cartridge may be used to store and dispense a two-part epoxy, where one chamber stores and dispenses the resin and the other chamber stores and dispenses the hardener. The fluid chambers may have equal internal volumes or different internal volumes as desired depending on the particular fluids being dispensed and their corresponding mixing ratios, for example a 1:1 mixing ratio or a 2:1 mixing ratio.

Fluid dispensing devices are used in conjunction with fluid cartridges, including side-by-side cartridges, for dispensing the stored fluid in precise amounts with repeatable accuracy. Traditional dispensing devices for side-by-side fluid cartridges include a dispenser body to which a side-by-side cartridge is attachable, and two pistons positioned side by side and each mounted on a plunger rod for extending the pistons from the dispenser body. In use, each piston is coaxially aligned with one of the fluid chambers of the fluid cartridge so that the pistons may extend into the fluid chambers to force the stored fluid out through the outlets of the cartridge. However, traditional fluid dispensing devices for use with side-by-side fluid cartridges present several drawbacks.

First, when attaching a side-by-side fluid cartridge to a traditional dispensing device, the cartridge must be moved from a first, assembly position into a second, dispensing position, for example by rotating or tilting the cartridge relative to the dispensing device. In the assembly position, the pistons are not aligned with the fluid chambers and thus are not extendable into the fluid chambers. Once the fluid cartridge is moved into the dispensing position, each piston is axially aligned with a corresponding fluid chamber of the cartridge and the dispensing device is ready for use. In this manner, the pistons are extendable and retractable within the fluid chambers of the side-by-side cartridge only when the cartridge has been moved from the assembly position into the dispensing position. Moreover, the side-by-side cartridge cannot be moved back to the assembly position for removal of the cartridge until the pistons have first been fully retracted from each of the fluid chambers. Attempting to move the cartridge from the dispensing position to the assembly position while the pistons are still extended into the fluid chambers would result in damaging the pistons and/or the plunger rods to which they are mounted. Accordingly, an operator must fully retract the pistons from the fluid chambers before removing the cartridge from the dispensing device. This step can become burdensome when using multiple consecutive cartridges in a dispensing application.

An additional drawback of traditional dispensing devices for side-by-side fluid cartridges relates to compatibility of the dispensing device with fluid cartridges having different flange thicknesses. Side-by-side fluid cartridges include a cartridge flange near the chamber inlets that engages the dispenser body when the cartridge and dispensing device are locked together in the dispensing position. Traditional dispensing devices include mating surfaces that are formed to accommodate only side-by-side cartridges having a cartridge flange of a particular thickness. Cartridge manufacturers often design their cartridges with a flange thickness that differs from that of cartridges produced by other manufacturers. Accordingly, an operator of a traditional dispensing device is generally restricted to use of cartridges produced by a particular manufacturer.

There is a need, therefore, for a fluid dispensing device for side-by-side fluid cartridges that addresses the present challenges such as those discussed above.

SUMMARY

An exemplary embodiment of a dispensing device for dispensing fluid from a side-by-side fluid cartridge having a first fluid chamber and a second fluid chamber includes a dispenser body, a first piston, a second piston, and an adapter head. The first piston is coupled with the dispenser body and is adapted to slide within the first fluid chamber. Similarly, the second piston is coupled with the dispenser body and is adapted to slide within the second fluid chamber. The adapter head is configured to releasably connect the side-by-side fluid cartridge to the dispenser body. More specifically, the adapter head is movable between a first position in which the side-by-side fluid cartridge is releasable from the dispenser body and a second position in which the side-by-side fluid cartridge is in locking engagement with the dispenser body. The first piston is coaxially aligned with the first fluid chamber and the second piston is coaxially aligned with the second fluid chamber when the adapter head is in the first position. Additionally, the first piston is coaxially aligned with the first fluid chamber and the second piston is coaxially aligned with the second fluid chamber when the adapter head is in the second position.

Another embodiment includes a dispensing device for dispensing fluid from a side-by-side fluid cartridge having a first fluid chamber, a second fluid chamber, and a cartridge flange having a flange thickness in an axial direction of the side-by-side fluid cartridge. The fluid dispensing device includes a dispenser body to which the side-by-side fluid cartridge is releasably connectable with the cartridge flange. The fluid dispensing device further includes a plate coupled with the dispenser body and movable in the axial direction of the side-by-side fluid cartridge between a first position for receiving a first cartridge flange having a first flange thickness and a second position for receiving a second cartridge flange having a second flange thickness.

In use, a method of releasably connecting a side-by-side fluid cartridge to a fluid dispensing device is directed to a side-by-side fluid cartridge having a first fluid chamber and a second fluid chamber, and a fluid dispensing device having a dispenser body, a first piston coupled with the dispenser body and adapted to slide within the first fluid chamber, a second piston coupled with the dispenser body and adapted to slide within the second fluid chamber, and an adapter head coupled with the dispenser body. The method includes placing the adapter head in a first position in which the adapter head is configured to receive a portion of the side-by-side fluid cartridge. The method further includes positioning the side-by-side fluid cartridge adjacent to the dispenser body while the adapter head is in the first position such that the first piston is coaxially aligned with the first fluid chamber and the second piston is coaxially aligned with the second fluid chamber. Additionally, the method further includes moving the adapter head into a second position to lock the side-by-side fluid cartridge with the dispenser body while the first piston remains coaxially aligned with the first fluid chamber and the second piston remains coaxially aligned with the second fluid chamber.

In another embodiment, a method of releasably connecting a side-by-side fluid cartridge to a fluid dispensing device is directed to a fluid dispensing device having a dispenser body and a plate coupled with the dispenser body, the plate being movable in an axial direction of the side-by-side fluid cartridge, the side-by-side fluid cartridge including a cartridge flange having a flange thickness in the axial direction of the side-by-side fluid cartridge. The method includes placing the plate in a first position in which the dispenser body is configured to receive a first cartridge flange having a first flange thickness. The method further includes connecting the first cartridge flange to the dispenser body with the plate in the first position. Additionally, the method includes removing the first cartridge flange from the dispenser body. Furthermore, the method includes moving the plate toward a second position in which the dispenser body is configured to receive a second cartridge flange having a second flange thickness different than the first flange thickness.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
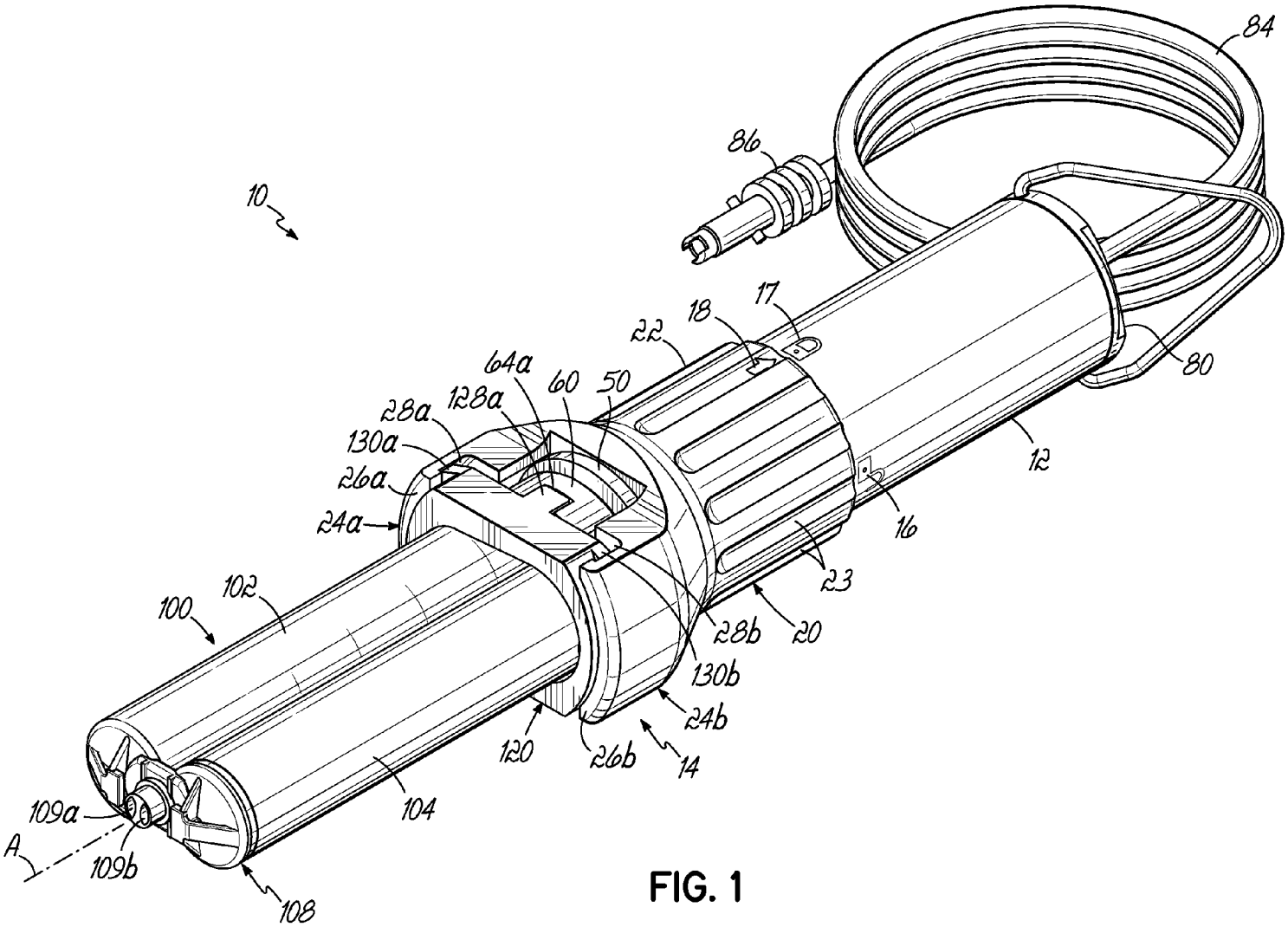
FIG. 1 is an isometric view showing a dispensing device and a side-by-side fluid cartridge with an adapter ring being held in locking engagement with the dispensing device by an adapter head in a locked position.
Figure 2A:
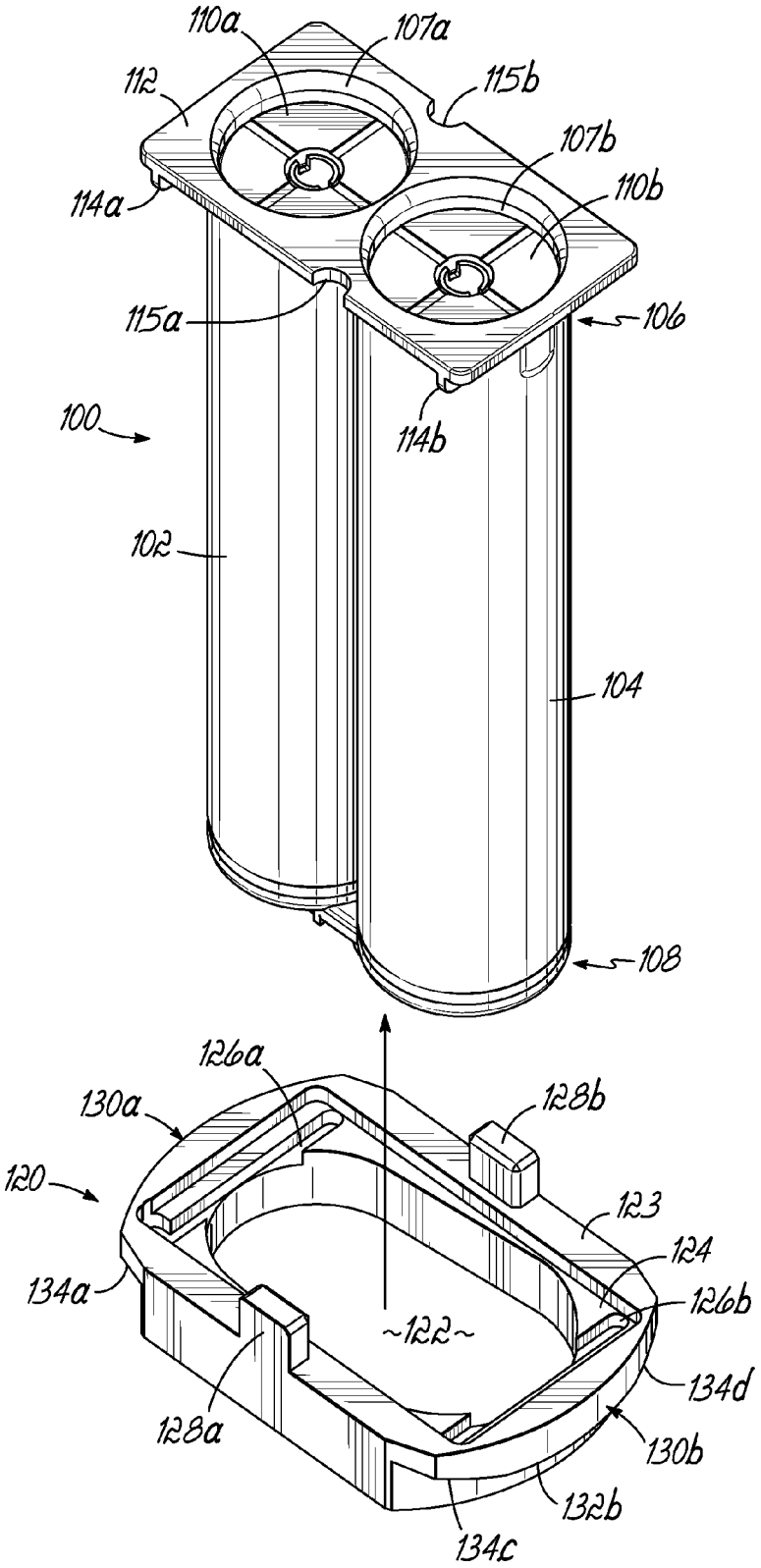
FIG. 2A is an isometric view showing the side-by-side fluid cartridge and adapter ring of FIG. 1 in a disassembled configuration.
Figure 2B:
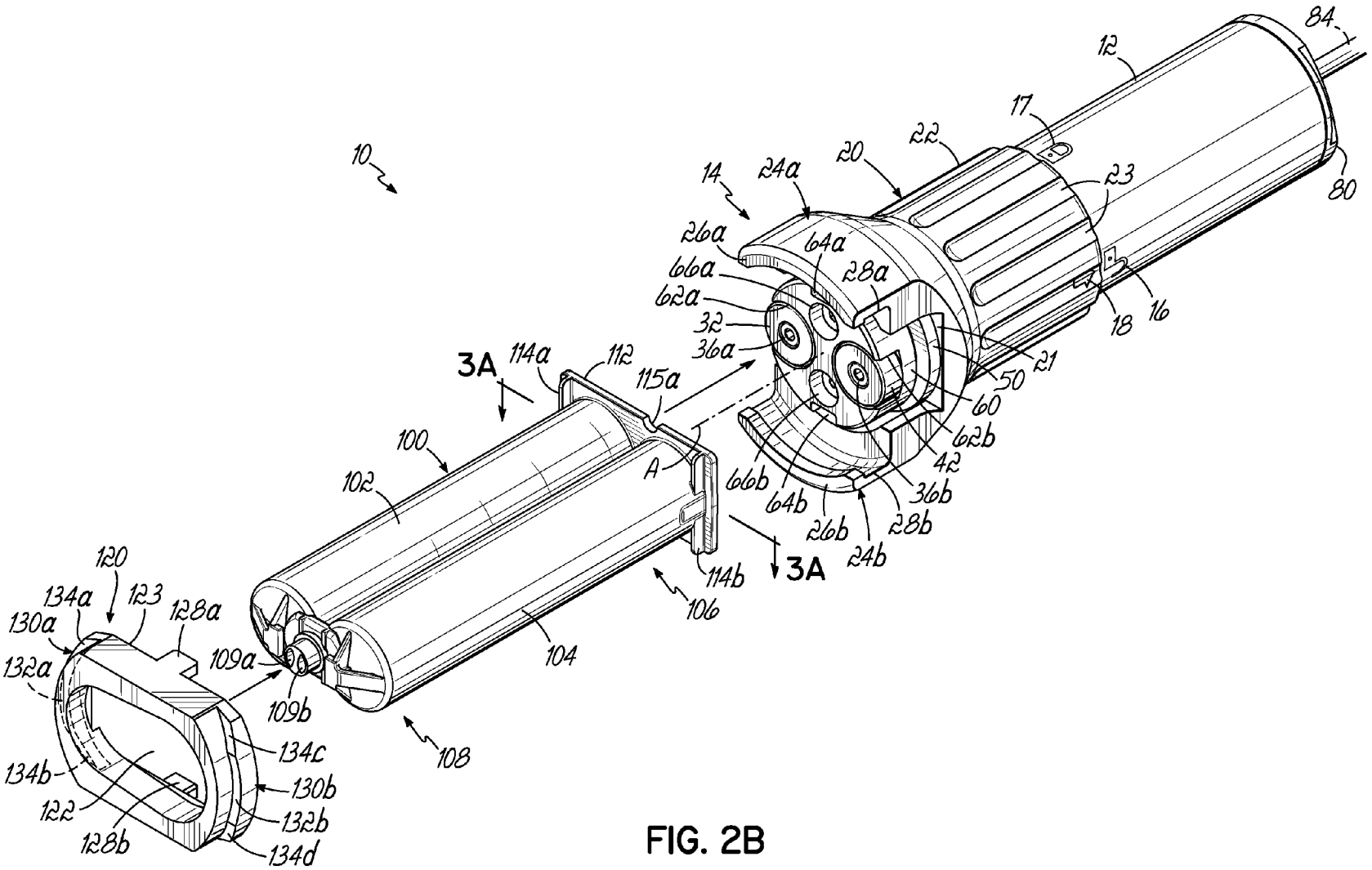
FIG. 2B is an isometric view showing the dispensing device, the side-by-side fluid cartridge, and an adapter ring in a disassembled configuration, and showing the manner in which the components are connected when the adapter head is in an unlocked position.
Figure 2C:
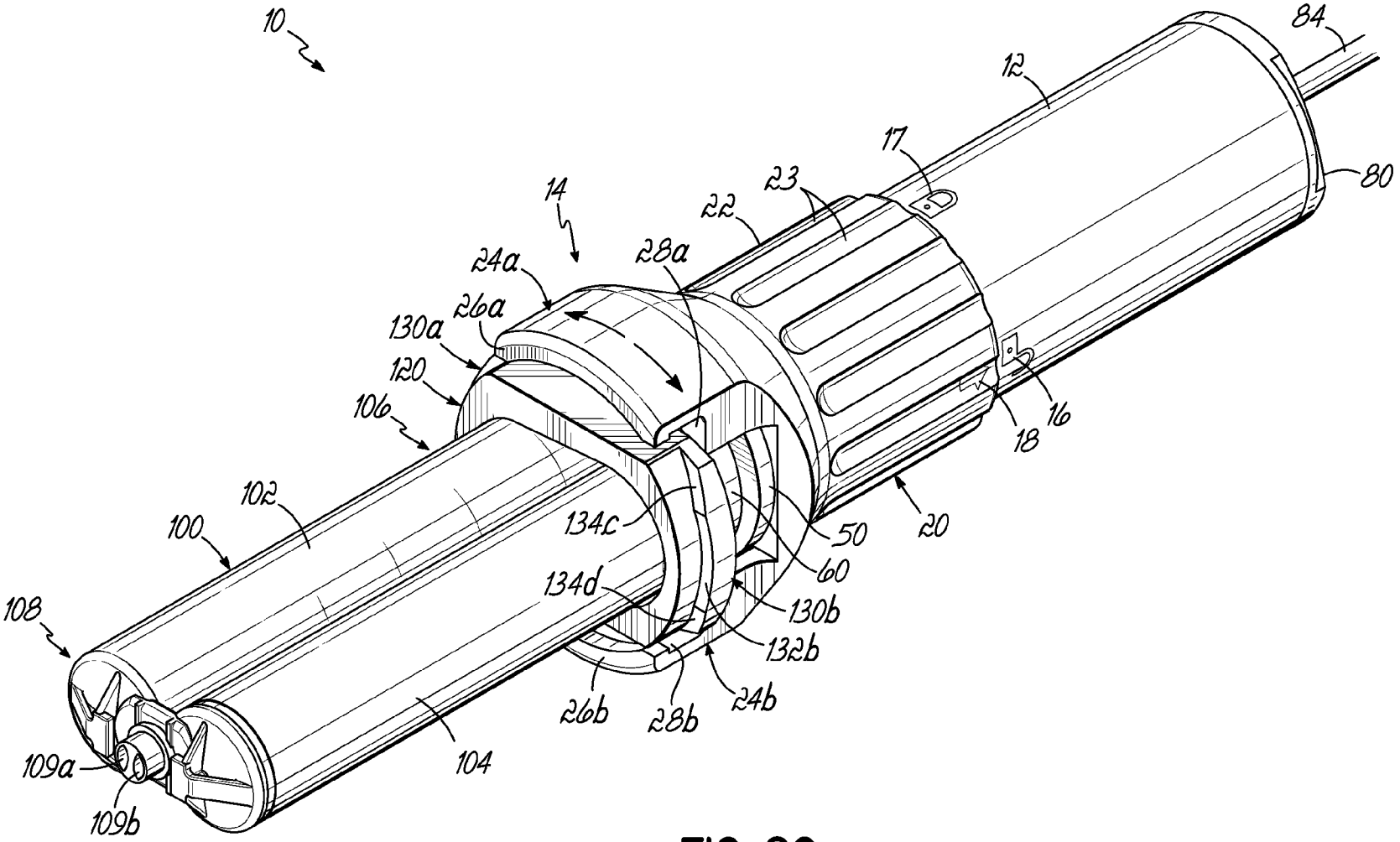
FIG. 2C is an isometric view showing the dispensing device, the side-by-side fluid cartridge, and the adapter ring in an assembled configuration and with the adapter head in the unlocked position and rotatable into the locked position.

Referring to FIGS. 1 through 2C, a dispensing device 10 for dispensing fluid from a side-by-side fluid cartridge 100 includes a dispenser body 12 and an adapter head 20 configured to releasably connect the fluid cartridge 100 to the dispenser body 12.

As best shown in FIGS. 2A and 2B, the side-by-side fluid cartridge 100 includes a first fluid chamber 102 and second fluid chamber 104 positioned adjacent to and parallel with the first fluid chamber 102. Each fluid chamber 102, 104 is preferably cylindrical with a generally circular cross-section. As shown, the first fluid chamber 102 may have an internal volume that is equal to the internal volume of the second fluid chamber 104. Alternatively, though not shown, one of the fluid chambers 102, 104 may have an internal volume that is greater than that of the other of the fluid chambers 102, 104. For example, the fluid cartridge 100 may be any Nordson EFD 50 milliliter side-by-side cartridge having fluid chambers with internal volume ratios of 1:1 or 2:1.

The side-by-side fluid cartridge 100 includes a proximal end 106 configured to operatively engage the dispenser body 12 of the dispensing device 10. The proximal end 106 of the fluid cartridge 100 defines a pair of chamber inlets 107*a* and 107*b* through which the fluid chambers 102, 104 may be filled with fluid. A distal end 108 of the fluid cartridge 100 defines a pair of chamber outlets 109*a* and 109*b* through which stored fluid is dispensed from the fluid chambers 102, 104. Cartridge pistons 110*a* and 110*b* (also shown in FIGS. 3A-3C) are provided within the fluid chambers 102, 104 such that they overlie the stored fluid. Each cartridge piston 110*a*, 110*b* makes sealing contact with an inner circumference of the corresponding fluid chamber 102, 104, and is movable in an axial direction of the fluid chamber 102, 104 toward the distal end 108 for forcing stored fluid out through the chamber outlets 109*a*, 109*b*. A cartridge flange 112 is provided at the proximal end 106 of the fluid cartridge 100 and may have one or more alignment features, such as ribs 114*a* and 114*b* and notches 115*a* and 115*b*, for engaging with corresponding structure on an adapter ring 120, as described in greater detail below.

The adapter ring 120, as best shown in FIGS. 2A-2C, is adapted to be removably coupled with the side-by-side fluid cartridge 100 and to contact the adapter head 20 to retain the fluid cartridge 100 in locking engagement with the dispenser body 12. In this regard, the adapter ring 120 includes a central aperture 122 extending fully through the adapter ring 120 in an axial direction. The central aperture 122 is sized and shaped so that the distal end 108 of the fluid cartridge 100 may be inserted through the central aperture 122. The adapter ring 120 is then slid over the exterior surface of the fluid chambers

102, 104 toward the cartridge flange 112 at the proximal end 106 of the fluid cartridge 100, as indicated by the arrows in FIGS. 2A and 2B.

A proximal surface 123 of the adapter ring 120 includes a primary recess 124 for receiving the cartridge flange 112 when the fluid cartridge 100 and the adapter ring 120 are coupled together. The adapter ring 120 may also include one or more secondary recesses for receiving corresponding alignment features provided on a fluid cartridge being used with the dispensing device 10. For example, as shown, the adapter ring 120 includes slots 126*a* and 126*b* for receiving the ribs 114*a*, 114*b* provided on the cartridge flange 112. The adapter ring 120 may be formed with secondary recesses of any shape and quantity for receiving corresponding additional alignment features provided on fluid cartridges produced by various cartridge manufacturers. Additionally, as shown, the adapter ring 120 includes a pair of opposed alignment tabs 128*a* and 128*b* extending from the proximal surface 123 of the adapter ring 120 in an axial direction. The alignment tabs 128*a*, 128*b* are received within corresponding alignment recesses 64*a* and 64*b* provided on a pressure plate 60 coupled with the dispenser body 12 for facilitating proper alignment of the side-by-side fluid cartridge 100 with the dispensing device 10, as described below.

The adapter ring 120 further includes a pair of opposed locking wings 130*a* and 130*b* extending radially outward for engaging the adapter head 20 of the dispensing device 10 and retaining the side-by-side fluid cartridge 100 in locking engagement with the dispenser body 12, as described below. Locking wings 130*a* includes a locking surface 132*a* and inclined ramps 134*a* and 134*b* formed at the ends of the locking surface 132. Similarly, locking wing 130*b* includes a locking surface 132*b* and inclined ramps 134*c* and 134*d* formed at the ends of the locking surface 132*b*, as best shown in FIG. 2B. The inclined ramps 134*a*-134*d* facilitate engagement of the adapter head 20 with the locking wings 130*a*, 130*b* as seen in FIG. 1 and as described in greater detail below.

As shown in FIG. 2B, the adapter head 20 of the dispensing device 10 is coupled with an operating end 14 of the dispenser body 12 and is rotatable about a central axis A. The adapter head 20 includes a cylindrically shaped collar 22 and a pair of diametrically opposed jaws 24*a* and 24*b* integrally formed with and extending outwardly from the collar 22. The collar 22 overlies a portion of the dispenser body 12 and may include one or more gripping slots 23 to provide an easily-gripped surface for an operator when rotating the adapter head 20 between unlocked and locked positions, as described below. As shown, the gripping slots 23 extend in an axial direction on an external surface of the collar 22 and are spaced circumferentially about the central axis A. The opposed jaws 24*a*, 24*b* extend radially and axially outward from the collar 22 in a direction away from the dispenser body 12. Respectively, jaws 24*a*, 24*b* include lips 26*a* and 26*b* that wrap partly circumferentially about the central axis A to define locking channels 28*a* and 28*b* for engaging the locking wings 130*a*, 130*b* of the adapter ring 120, as described in greater detail below.

The adapter head 20 is rotatable about the central axis A between a first, unlocked position (shown in FIGS. 2A and 2B) in which the fluid cartridge 100 is releasable from the dispenser body 12, and a second, locked position (shown in FIG. 1) in which the fluid cartridge 100 is held in locking engagement with the dispenser body 12. The extent to which the adapter head 20 must be rotated in order to fully achieve the first, unlocked position or the second, locked position may be made visually apparent to an operator by reference marks provided on the external surfaces of the adapter head 20 and the dispenser body 12. For example, as shown, an unlocked symbol 16 and a locked symbol 17, shown in the form of unlocked and locked padlocks, may be printed on an external surface of the dispenser body 12, and a corresponding indicator arrow 18 may be printed on the collar 22 of the adapter head 20. Accordingly, the operator will understand that in order to achieve a fully locked position the adapter head 20 must be rotated until the indicator arrow 18 is aligned with the locked symbol 17. Similarly, the operator will understand that in order to achieve a fully unlocked position the adapter head 20 must be rotated until the indicator arrow 18 is aligned with the unlocked symbol 16. The symbols 16, 17 and the indicator arrow 18 may be substituted with any other suitable visual reference marks, such as dots, lines, characters, shapes, or any combination thereof.

As is apparent from the figures and the description below with respect to the jaws 24*a*, 24*b* and the locking wings 130*a*, 130*b*, the fluid cartridge 100 is attachable to and separable from the dispenser body 12 only when the adapter head 20 is placed in a fully unlocked position, that is, when the indicator arrow 18 is aligned with the unlocked symbol 16. With reference to FIGS. 2B and 2C, for example, if the adapter head 20 is rotated to any position other than a fully unlocked position in which the indicator arrow 18 is aligned with the unlocked symbol 16, as shown, the adapter ring 120 and cartridge 100 would be blocked by the jaws 24*a*, 24*b* from mating with the dispenser body 12. Specifically, the lips 26*a*, 26*b* of the jaws 24*a*, 24*b* would collide with the locking wings 130*a*, 130*b* to prevent the alignment tabs 128*a*, 128*b* from being received within the corresponding alignment recesses 64*a*, 64*b* on the pressure plate 60.

Similarly, as is apparent from FIG. 1, once the fluid cartridge 100 and the adapter ring 120 are locked against the dispenser body 12 with the jaws 24*a*, 24*b*, the fluid cartridge 100 is not releasable from the dispenser body 12 until the adapter head 20 is fully rotated back to the unlocked position in which the indicator arrow 18 aligns with the unlocked symbol 16. If the adapter head is in any position other than the fully unlocked position, the lip 26*a* will engage at least a portion of the locking wing 130*a* and the lip 26*b* will engage at least a portion of the locking wing 130*b*, thereby retaining the fluid cartridge 100 in at least partial locking engagement with the dispenser body 12. In such instance, the fluid cartridge 100 is still positioned such that the dispensing device 10 is operable to dispense fluid from the cartridge 100. However, a partially locked configuration poses a risk of sudden, inadvertent separation of the fluid cartridge 100 from the dispenser body 12, which may be detrimental to a fluid dispensing operation. Accordingly, the unlocked and locked symbols 16, 17 serve to visually inform the operator as to when the adapter head 20 is properly positioned such that the fluid cartridge 100 is securely attached to the dispenser body 12 in the fully locked position and thus ready for a dispensing operation.

Figure 5:
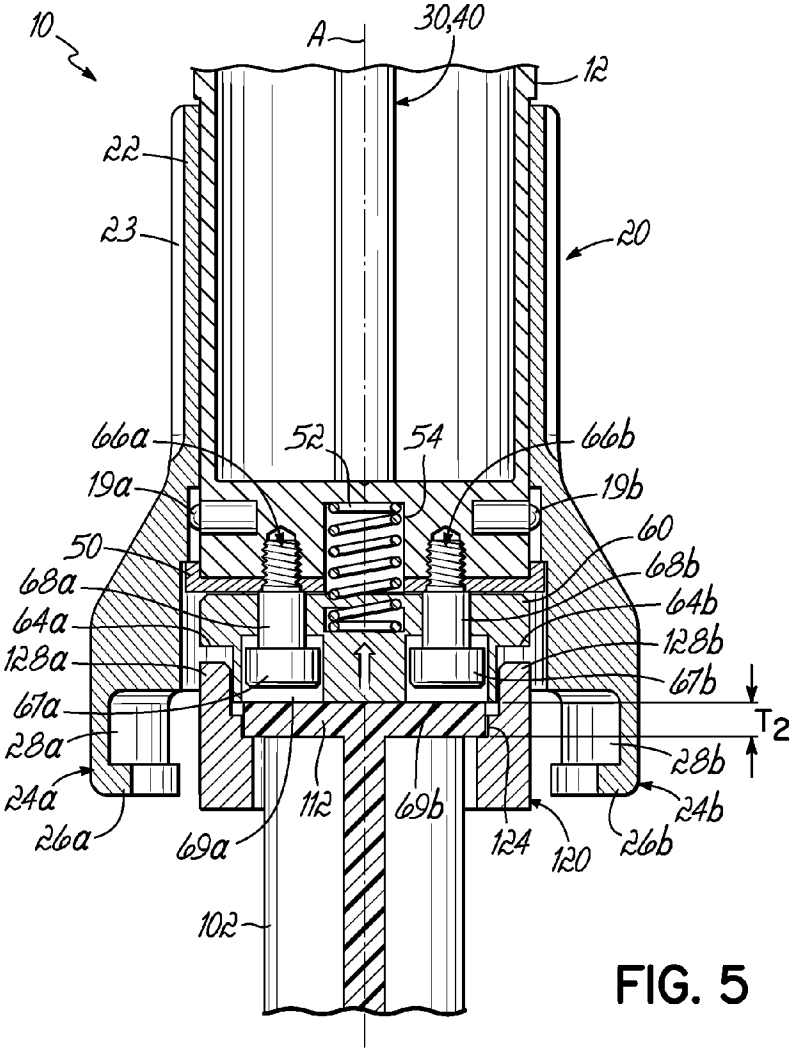
FIG. 5 is an enlarged side cross-sectional view similar to FIG. 4, but showing the pressure plate in a second position for receiving a second cartridge flange having a second flange thickness.
Figure 4:
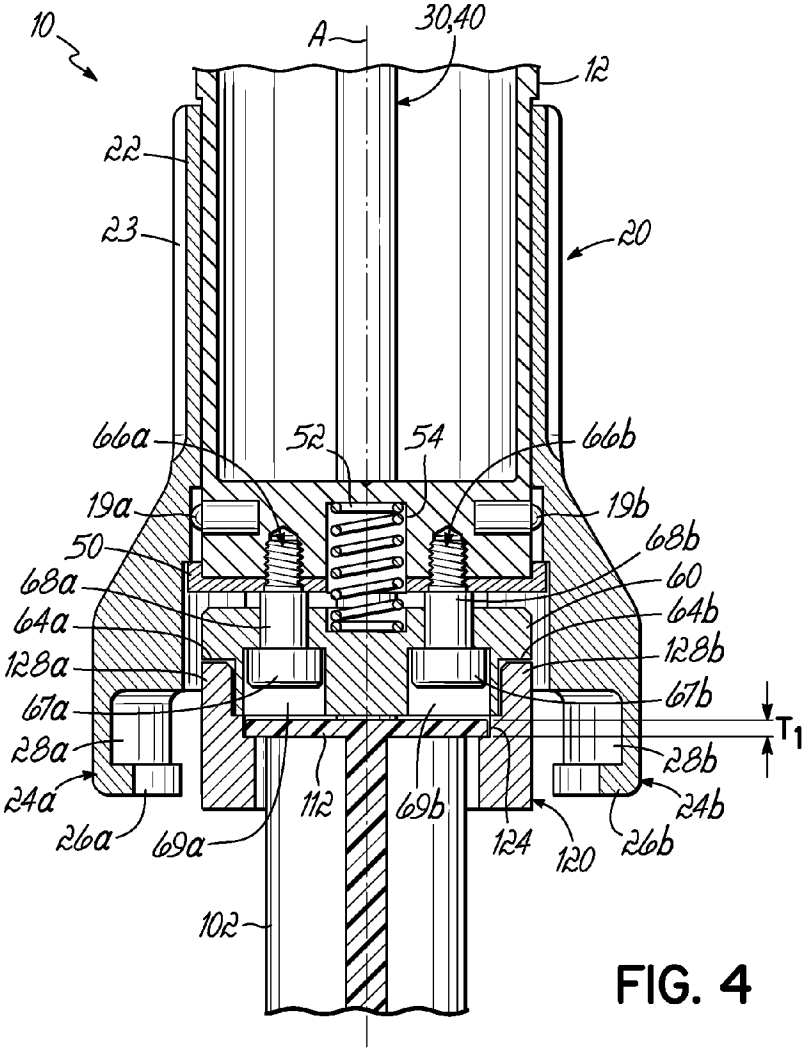
FIG. 4 is an enlarged side cross-sectional view taken along section line 4-4 in FIG. 3B, showing a pressure plate in a first position for receiving a first cartridge flange having a first flange thickness.

As shown in FIGS. 4 and 5, the dispenser body 12 may also be provided with one or more ball detents 19*a* and 19*b* for further communicating to the operator when the adapter head 20 is placed in the first, fully unlocked position or the second, fully locked position. The ball detents 19*a*, 19*b* are positioned to engage a radially inner surface of the adapter head 20 and thereby provide tactile feedback to the operator when the adapter head 20 is placed into the first, unlocked position when the indicator arrow 18 is aligned with the unlocked symbol 16 and also the second, locked position when the indicator arrow 18 is aligned with the locked symbol 17.

As shown best in FIGS. 1 and 2C, the adapter head 20 is rotatable through approximately ninety degrees when moving between the first, unlocked position and the second, locked position. While the figures show a single unlocked position and a single locked position, the diametrically opposed structure of the jaws 24*a*, 24*b* and the locking wings 130*a*, 13*b* shown and described herein provide for two unlocked positions that alternate with two locked positions at ninety degree intervals about the central axis A. Accordingly, the adapter head 20 may be rotated either clockwise or counterclockwise to transition between any unlocked position and an adjacent locked position. Persons of ordinary skill in the art will appreciate that alternative designs of the jaws 24 and the locking wings 130 would allow for alternating unlocked and locked positions of various quantities that are spaced circumferentially at various corresponding intervals about the central axis A.

The dispensing device 10 further includes a first plunger 30 having a first plunger piston 32 and a second plunger 40 having a second plunger piston 42. As described in greater detail below with reference to FIGS. 4 and 5, the plungers 30, 40 are coupled with the operating end 14 of the dispenser body 12 and are operable to extend and retract relative to the dispenser body 12 in a direction parallel to the central axis A. As shown in FIG. 2B, the plunger pistons 32, 42 are substantially disk-shaped and are positioned adjacent to one another in a side-by-side manner such that they are in coaxial alignment with the fluid chambers 102, 104 of the side-by-side fluid cartridge 100 when the fluid cartridge 100 and adapter ring 120 are mated with the dispensing device 10. Furthermore, each plunger piston 32, 42 is sized as appropriate to be received and be slidable within its corresponding fluid chamber 102, 104. For example, if a side-by-side fluid cartridge having a chamber volume ratio of 2:1 (not shown) is used with the dispensing device 10, one of the plunger pistons 32, 42 would be formed with a diameter corresponding to the diameter of the smaller fluid chamber, while the other of the plunger pistons 32, 42 would be formed with a diameter corresponding to the diameter of the larger fluid chamber. Similarly, the cartridge pistons 110*a*, 110*b* would be formed with a diameter corresponding to the diameter of their respective fluid chambers.

The dispensing device 10 further includes a retainer plate 50 and a pressure plate 60 coupled with the operating end 14 of the dispenser body 12 with shoulder screws 66*a* and 66*b*, as best shown in FIGS. 1, 2B, and 3A-3C, 4, and 5. The retainer plate 50 abuts a base surface 21 of the adapter head 20 and operates to retain the adapter head 20 in coupling engagement with the dispenser body 12. The pressure plate 60 is positioned axially adjacent to the retainer plate 50 and operates to abut at least one of the cartridge flange 112 or the adapter ring 120 when the fluid cartridge 100 and adapter ring 120 are mated with the dispensing device 10, as described in greater detail below with reference to FIGS. 4 and 5. As shown in FIG. 2B, the pressure plate 60 includes a pair of piston recesses 62*a* and 62*b* that extend in an axial direction and are sized and shaped to fully receive the plunger pistons 32, 42, respectively, when the pistons 32, 42 are in a fully retracted position. The pressure plate 60 additionally includes alignment recesses 64*a* and 64*b* that are formed in an axial direction and are sized and shaped to receive the alignment tabs 128*a* and 128*b*, respectively, of the adapter ring 120, as shown in FIGS. 1 and 2B.

Referring to FIGS. 2A-2C, the adapter ring 120, the side-by-side fluid cartridge 100, and the fluid dispensing device 10 are preferably assembled in the manner shown. The adapter ring 120 is coupled with the fluid cartridge 100 in the manner described above. Specifically, the adapter ring 120 is slid over an exterior surface of the fluid cartridge 100 from the distal end 108 toward the proximal end 106 such that the fluid chambers 102, 104 are positioned within the central aperture 122, the cartridge flange 112 is received within the primary recess 124, and the ribs 114*a*, 114*b* are received within the slots 126*a*, 126*b*, respectively. As shown in FIG. 2B, the adapter head 20 is placed in the first, unlocked position and the plunger pistons 32, 42 are preferably placed in a fully retracted position. The fluid cartridge 100 and adapter ring 120, once assembled, are ready to be mated with the operating end 14 of the dispensing device 10.

As shown in FIGS. 2B and 2C, the fluid cartridge 100 is presented to the operating end 14 of the dispensing device 10 such that the cartridge flange 112 and adapter ring 120 abut the pressure plate 60, and the alignment tabs 128*a*, 128*b* of the adapter ring 120 are received within the corresponding alignment recesses 64*a*, 64*b* of the pressure plate 60. As shown in FIG. 2C, the above described components are now assembled with the adapter head in the first, unlocked position. In this configuration, the first plunger piston 32 is in coaxial alignment with the first fluid chamber 102 and the second plunger piston 42 is in coaxial alignment with the second fluid chamber 104. The adapter head 20 is not yet engaged with the adapter ring 120, and thus the fluid cartridge 100 is still freely removable from the dispensing device 10 in the configuration shown in FIG. 2C.

Next, the adapter head 20 is rotated from the first, unlocked position into the second, locked position in which the fluid cartridge 100 is held in locking engagement with the dispenser body 12, as shown in FIG. 1. More specifically, the adapter head 20 is rotated about the central axis A so that the lips 26*a*, 26*b* of the opposed jaws 24*a*, 24*b* first engage and exert an axial force on the two of the inclined ramps 134*a*-134*d* of the locking wings 130*a*, 130*b* in a direction toward the dispenser body 12. For example, if the adapter head 20 is rotated in a direction from the unlocked symbol 16 toward the locked symbol 17, lip 26*a* engages inclined ramp 134*a* while lip 26*b* engages inclined ramp 134*d*. Further rotation of the adapter head 20 toward the second, locked position advances the lip 26*a* over locking surface 132*a* and lip 24*b* over locking surface 132*b* of locking wing 130*b*, such that the locking wing 130*a* is received within locking channel 28*a* and locking wing 130*b* is received within locking channel 28*b* of the adapter head 20. Rotation of the adapter head 20 in the opposite direction would achieve a similar result, though would involve lip 26*a* first engaging inclined ramp 134*c* and lip 26*b* first engaging inclined ramp 134*b*. With the adapter head 20 rotated fully into the second, locked position, as shown in FIG. 1, the lips 26*a*, 26*b* of the jaws 24*a*, 24*b* continue to exert an axial force on the locking surfaces 132*a*, 132*b* in a direction toward the dispenser body 12. In turn, the adapter ring 120 exerts an axial force on the cartridge flange 112 in a direction toward the dispenser body 12. Accordingly, the fluid cartridge 100 is held in locking engagement with the dispenser body 12 when the adapter head 20 is in the second, locked position, as shown in FIG. 1.

Figure 3A:
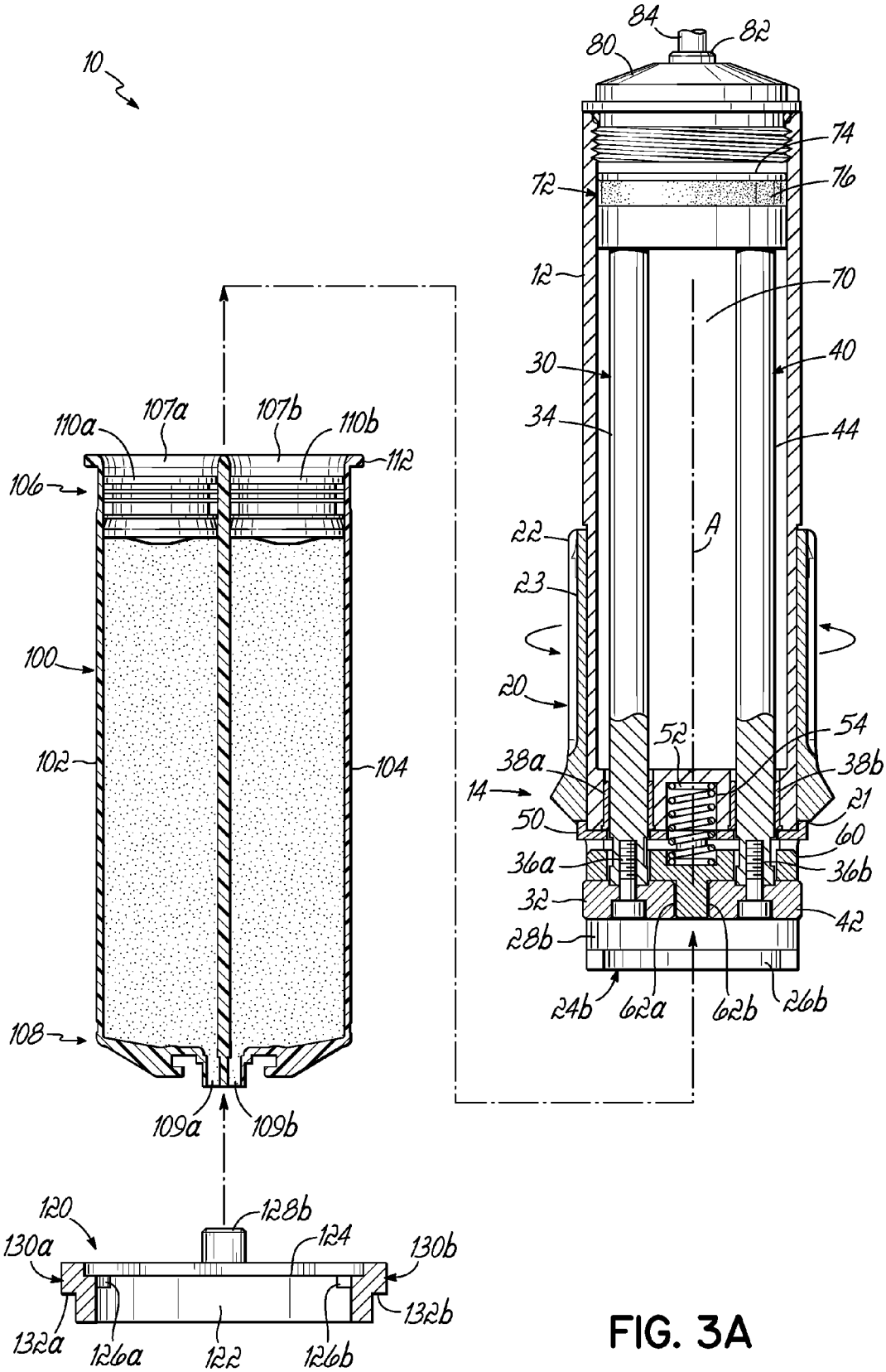
FIG. 3A is a front cross-sectional view taken along section line 3A-3A of FIG. 2B, showing the dispensing device, the side-by-side fluid cartridge, and the adapter ring in a disassembled configuration, with the adapter head partially hidden.
Figure 3B:
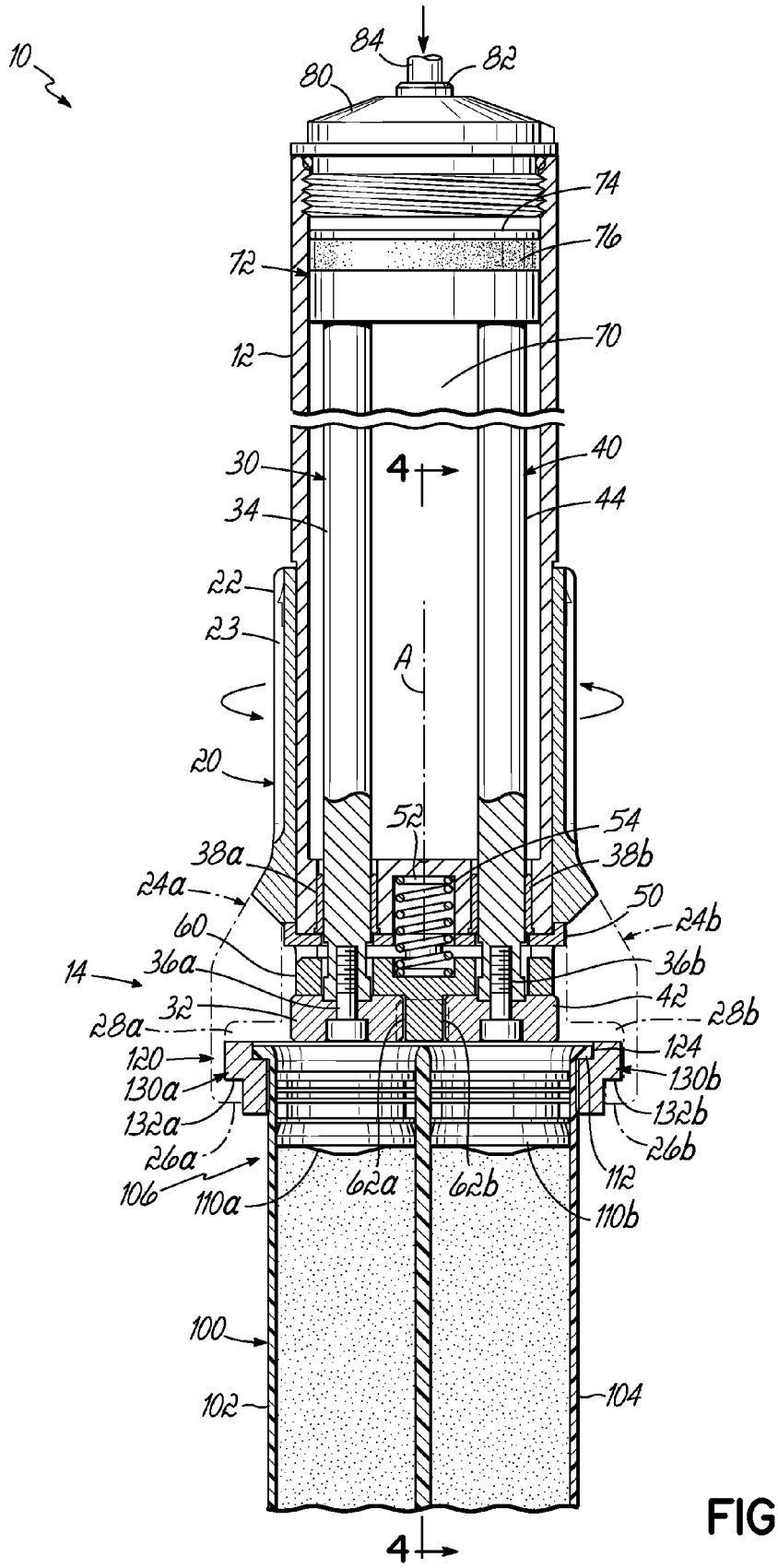
FIG. 3B is a front cross-sectional view similar to FIG. 3A, but showing the dispensing device, the side-by-side fluid cartridge, and the adapter ring in an assembled configuration, and showing the adapter head (partially in phantom) in the locked position and first and second plungers in a fully retracted position.
Figure 3C:
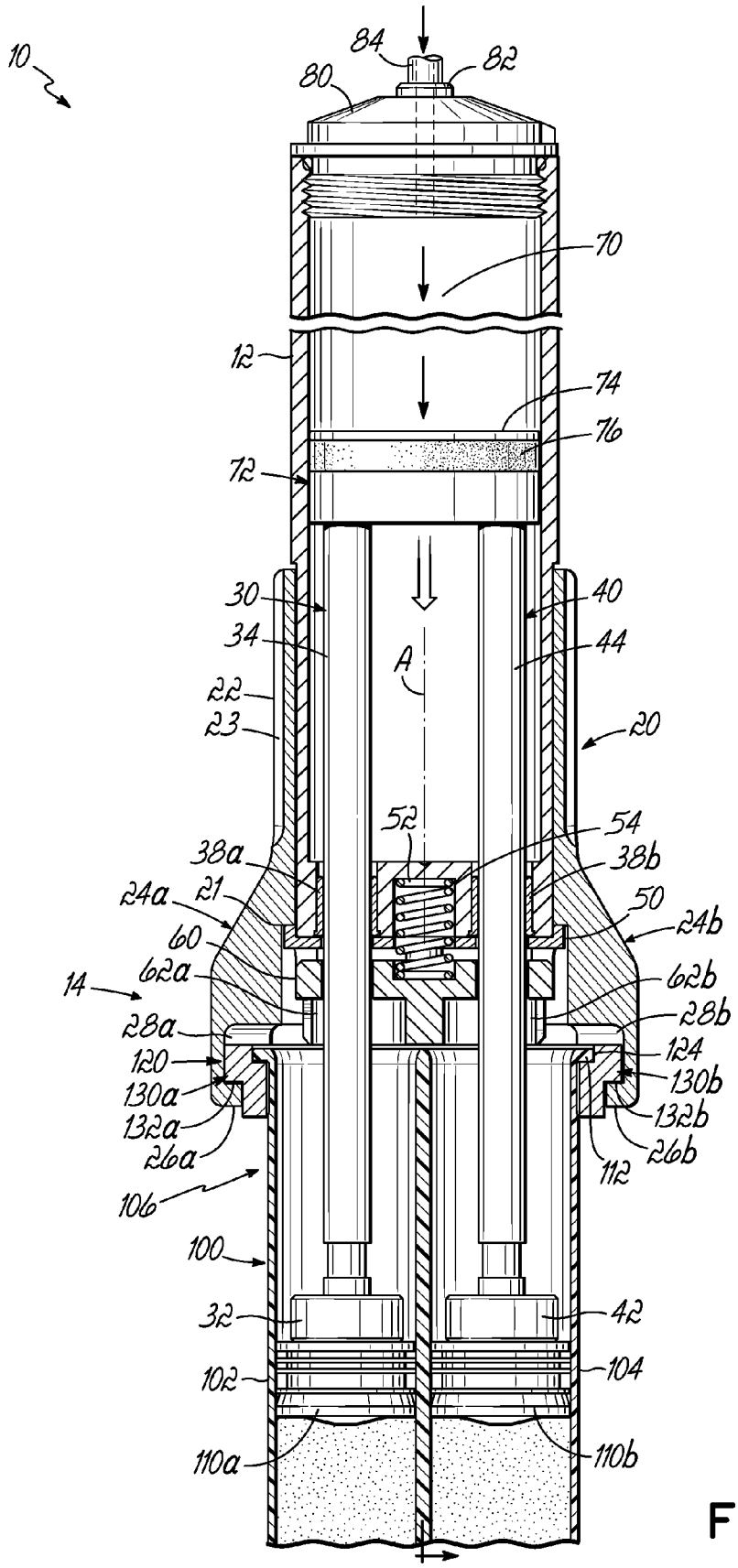
FIG. 3C is a front cross-sectional view similar to FIG. 3B, but showing the plungers in a partially extended position.

FIGS. 3A-3C are axial cross-sectional views showing additional structural detail of the above-described components. FIG. 3A shows the adapter ring 120, the side-by-side fluid cartridge 100, and the fluid dispensing device 10 in a disassembled configuration similar to FIG. 2B, with jaw 24*b* of the adapter head 20 being partially hidden. As shown, the first plunger piston 32 is mounted to a first plunger rod 34 to form the first plunger 30, and the second plunger piston 42 is mounted to a second plunger rod 44 to form the second plunger 40. The plunger rods 34, 44 are slidable through corresponding plunger bushings 38*a* and 38*b* provided at the operating end 14 of the dispenser body 12. The plunger pistons 32, 42 are mounted to the plunger rods 34, 44 using screws 36*a* and 36*b*, respectively. Accordingly, the plunger pistons 32, 42 are removable from the plunger rods 34, 44 and may be interchanged with plunger pistons of various diameters (not shown) as desired to correspond with and be slidable within fluid chambers of various diameters (not shown). For example, a 2:1 ratio side-by-side fluid cartridge (not shown) includes first and second fluid chambers of different diameters and thus requires correspondingly sized plunger pistons to be slidable within the fluid chambers.

The dispenser body 12 includes a pneumatic air cylinder having an internal air chamber 70 and an air piston 72. The air piston 72 includes a crown 74 and a circumferential air seal 76, and is coupled with the first and second plunger rods 34, 44. The air piston 72 is slidable within the internal air chamber 70 along the central axis A for extending and retracting the plungers 30, 40 relative to the operating end 14 of the dispenser body 12. A threaded endcap 80 is provided at an end of the dispenser body 12 opposite the operating end 14 and includes an air inlet port 82 through which forced air may be passed. An air hose 84, best shown in FIG. 1, may be attached to the air inlet port 82 at one end and to an air supply (not shown) at an opposite end with a connector 86, which may include any suitable mechanical fitting such as a quick-connect fitting. The air supply is capable of providing forced air to the dispensing device 10, and may be an electro-pneumatic dispenser such as the Nordson EFD Ultimus™ or the Performus™, for example.

As shown in FIG. 3B, the adapter ring 120 is coupled with the fluid cartridge 100 and this assembly is mated with the dispensing device 10 in the manner described above. As shown, the adapter head 20 is rotated into the second, locked position such that the opposed jaws 24*a*, 24*b* (shown in phantom) engage the locking wings 130*a*, 130*b* of the adapter ring 120 and thereby retain the fluid cartridge 100 in locking engagement with the dispenser body 12. In the configuration shown, the plungers 30, 40 are in a fully retracted position in which the plunger pistons 32, 42 are fully seated within the piston recesses 62*a*, 62*b* of the pressure plate 60. Furthermore, the first plunger piston 32 is coaxially aligned with the first fluid chamber 102 and the second plunger piston 42 is coaxially aligned with the second fluid chamber 104, while each plunger piston 32, 42 is axially adjacent to and overlies a cartridge piston 110*a*, 110*b* disposed within the corresponding fluid chamber 102, 104.

As shown in FIG. 3C, the air supply is operated to pass forced air into the internal air chamber 70 through the air inlet port 82, as indicated by the solid arrows. The forced air creates an internal pressure within the air chamber 70 and thereby forces the air piston 72 to slide along the central axis A in a direction toward the fluid cartridge 100, as indicated by the hollow arrow. In turn, the air piston 72 forces the plungers 30, 40 to extend axially outward from the dispenser body 12 and into the fluid chambers 102, 104. In this manner, the first plunger piston 32 is slidable within the first fluid chamber 102 and the second plunger piston 42 is slidable within the second fluid chamber 104. The plunger pistons 32, 42 engage and force the cartridge pistons 110*a*, 110*b* axially toward the distal end 108 of the fluid cartridge 100 to thereby dispense the stored fluid from the chamber outlets 109*a*, 109*b*. FIG. 3C shows the plungers 30, 40 in a partially extended position and advancing axially outward toward a fully extended position.

As described above, the first and second plunger pistons 32, 42 remain coaxially aligned with the respective first and second fluid chambers 102, 104 throughout operation of the fluid dispensing device 10, regardless of whether the adapter head 20 is in an unlocked position or a locked position. Accordingly, the fluid cartridge 100 may be disengaged and removed from the dispenser body 12 even when the plungers 30, 40 are extended from the dispenser body 12 such that the plunger pistons 32, 42 are positioned within the fluid chambers 102, 104. For example, with reference to FIG. 3C, after extending the plunger pistons 32, 42 at least partially into the fluid chambers 102, 104, an operator may rotate the adapter head 20 from the second, locked position back into the first, unlocked position to thereby disengage the adapter head 20 from the adapter ring 120. With the adapter head 20 back in the first, unlocked position, the first and second plunger pistons 32, 42 remain coaxially aligned with the respective first and second fluid chambers 102, 104 such that the fluid cartridge 100 may be separated from the dispensing device 10 while the plungers 30, 40 remain at least partially extended.

FIGS. 4 and 5 illustrate additional functional aspects of the pressure plate 60. Specifically, the pressure plate 60 is movable along the central axis A to accommodate cartridge flanges having a variety of flange thicknesses. The pressure plate 60 is coupled to the dispenser body 12 with shoulder screws 66*a* and 66*b*. Respectively, each screw 66*a*, 66*b* includes a head 67*a*, 67*b* recessed within a counterbore 69*a*, 69*b* and a shoulder 68*a*, 68*b* extending axially through the pressure plate 60. The pressure plate 60 is slidable along the shoulders 68*a*, 68*b* in an axial direction, and the shoulders 68*a*, 68*b* have a length sufficient to permit any desired sliding displacement of the pressure plate 60 relative to the retainer plate 50. A spring 52, shown as a compression spring, is provided within a spring pocket 54 that extends in an axial direction and that is formed jointly by the pressure plate 60 at one end and by the dispenser body 12 at the other end. The spring 52 thus abuts the pressure plate 60 at one end and abuts the dispenser body 12 at the other end to thereby bias the pressure plate 60 in an axial direction toward the cartridge flange 112.

FIG. 4 shows the cartridge flange 112 having a first, smaller flange thickness $T_1$. With this flange thickness $T_1$, the cartridge flange 112 sits fully within the primary recess 124 of the adapter ring 120 such that the cartridge flange 112 exerts substantially no axially compressive force on the pressure plate 60. In turn, the alignment tabs 128*a*, 128*b* of the adapter ring 120 are substantially fully received within the corresponding alignment recesses 64*a*, 64*b* on the pressure plate 60. Accordingly, in the configuration shown, the pressure plate 60 is positioned in its axially outermost position as permitted by the shoulder screws 66*a*, 66*b*, such that the pressure plate 60 abuts the screw heads 67*a*, 67*b* within the counterbores 69*a*, 69*b*, respectively.

FIG. 5 shows the cartridge flange 112 having a second, larger flange thickness $T_2$. With this flange thickness $T_2$, the cartridge flange 112 extends beyond the axial dimension of the primary recess 124 of the adapter ring 120 so that the cartridge flange 112 abuts and exerts an axial compressive force on the pressure plate 60 in a direction toward the dispenser body 12. In turn, the pressure plate 60 slides axially along the shoulders 68*a*, 68*b* of the shoulder screws 66*a*, 66*b* to thereby compress the spring 52. In the configuration shown, the pressure plate 60 is positioned in its axially innermost position as permitted by the shoulder screws 66*a*, 66*b*, such that the pressure plate 60 is spaced from the screw heads 67*a*, 67*b* within the counterbores 69*a*, 69*b*, respectively. Persons of ordinary skill in the art will appreciate that the cartridge flange 112 may be formed with a flange thickness other than that represented by thicknesses $T_1$ and $T_2$ shown herein. Moreover, the shoulder screws 66*a*, 66*b*, as well as other relevant components of the dispensing device 10, may be formed with dimensions other than those represented herein to accommodate any desired range of cartridge flange thicknesses.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A dispensing device for dispensing fluid from a side-by-side fluid cartridge having a first fluid chamber and a second fluid chamber, the dispensing device comprising:

a dispenser body;

a first piston coupled with the dispenser body and configured to slide within the first fluid chamber;

a second piston coupled with the dispenser body and configured to slide within the second fluid chamber;

an adapter head configured to releasably connect the side-by-side fluid cartridge to the dispenser body, the adapter head being rotatable about a central axis of the dispenser body between a first position in which the side-by-side fluid cartridge is releasable from the dispenser body and a second position in which the side-by-side fluid cartridge is in locking engagement with the dispenser body; and an adapter ring configured to be removably coupled with the side-by-side fluid cartridge and to contact the adapter head to retain the side-by-side fluid cartridge in locking engagement with the dispenser body when the adapter head is in the second position, the adapter ring being removable from contact with the adapter head when the adapter head is in the first position, wherein the first piston is coaxially aligned with the first fluid chamber and the second piston is coaxially aligned with the second fluid chamber when the adapter head is in the first position, and wherein the first piston is coaxially aligned with the first fluid chamber and the second piston is coaxially aligned with the second fluid chamber when the adapter head is in the second position.

2. The dispensing device of claim 1, wherein the adapter head rotates through approximately ninety degrees when rotating between the first position and the second position.

3. The dispensing device of claim 1, wherein the adaptor head is configured to at least partially overlie an external surface of the adapter ring when the adapter head is in the second position.

4. The dispensing device of claim 1, wherein the dispenser body includes a pneumatic air cylinder operable to extend the first piston and the second piston outwardly from the dispenser body.

5. The dispensing device of claim 1, wherein an internal volume of the first fluid chamber is equal to an internal volume of the second fluid chamber.

6. The dispensing device of claim 1, wherein an internal volume of one of the first fluid chamber or the second fluid chamber is greater than an internal volume of the other of the first fluid chamber or the second fluid chamber.

7. The dispensing device of claim 1, wherein the side-by-side fluid cartridge includes a cartridge flange for releasably connecting to the dispenser body, the cartridge flange having a flange thickness in an axial direction of the side-by-side fluid cartridge, the dispensing device further comprising:

a plate coupled with the dispenser body and movable in the axial direction of the side-by-side fluid cartridge between a first position for receiving a first cartridge flange having a first flange thickness and a second position for receiving a second cartridge flange having a second flange thickness.

8. The dispensing device of claim 7, wherein the plate is biased toward at least one of the first cartridge flange or the second cartridge flange.

9. A dispensing device for dispensing fluid from a side-by-side fluid cartridge having a first fluid chamber, a second fluid chamber, and a cartridge flange having a flange thickness in an axial direction of the side-by-side fluid cartridge, the dispensing device comprising:

a dispenser body, the side-by-side fluid cartridge being releasably connectable thereto with the cartridge flange;

a plate coupled with the dispenser body and movable in the axial direction of the side-by-side fluid cartridge between a first position for receiving a first cartridge flange having a first flange thickness and a second position for receiving a second cartridge flange having a second flange thickness.

10. The dispensing device of claim 9, wherein the plate is biased toward at least one of the first cartridge flange or the second cartridge flange.

11. The dispensing device of claim 9, further comprising:

an adapter head configured to releasably connect the side-by-side fluid cartridge to the dispenser body, the adapter head being movable between a first position in which the side-by-side fluid cartridge is releasable from the dispenser body and a second position in which the side-by-side fluid cartridge is in locking engagement with the dispenser body.

12. The dispensing device of claim 11, further comprising:

a first piston coupled with the dispenser body and adapted to slide within the first fluid chamber; and a second piston coupled with the dispenser body and adapted to slide within the second fluid chamber;

wherein the first piston is coaxially aligned with the first fluid chamber and the second piston is coaxially aligned with the second fluid chamber when the adapter head is in the first position, and wherein the first piston is coaxially aligned with the first fluid chamber and the second piston is coaxially aligned with the second fluid chamber when the adapter head is in the second position.

13. A method of releasably connecting a side-by-side fluid cartridge to a fluid dispensing device, the side-by-side fluid cartridge having a first fluid chamber and a second fluid chamber, and the fluid dispensing device having a dispenser body, a first piston coupled with the dispenser body and configured to slide within the first fluid chamber, a second piston coupled with the dispenser body and configured to slide within the second fluid chamber, and an adapter head coupled with the dispenser body, and an adapter ring configured to be removably coupled with the side-by-side fluid cartridge, the method comprising:

placing the adapter head in a first position in which the adapter head is configured to receive a portion of the side-by-side fluid cartridge;

positioning the side-by-side fluid cartridge adjacent to the dispenser body while the adapter head is in the first position such that the first piston is coaxially aligned with the first fluid chamber and the second piston is coaxially aligned with the second fluid chamber;

positioning the adapter ring to contact the adapter head while the adapter head is in the first position, the adapter head being removable from contact with the adapter head when the adapter head is in the first position; and rotating the adapter head about a central axis of the dispenser body into a second position to engage the adapter ring and lock the side-by-side fluid cartridge with the dispenser body while the first piston remains coaxially aligned with the first fluid chamber and the second piston remains coaxially aligned with the second fluid chamber.

14. The method of claim 13, further comprising:

extending the first piston at least partially into the first fluid chamber and the second piston at least partially into the second fluid chamber;

rotating the adaptor head back into the first position to unlock the side-by-side fluid cartridge from the dispenser body; and removing the side-by-side fluid cartridge from the dispenser body.

15. A method of releasably connecting a side-by-side fluid cartridge to a fluid dispensing device having a dispenser body and a plate coupled therewith, the plate being movable in an axial direction of the side-by-side fluid cartridge, the side-by-side fluid cartridge including a cartridge flange having a flange thickness in the axial direction of the side-by-side fluid cartridge, the method comprising:

placing the plate in a first position in which the dispenser body is configured to receive a first cartridge flange having a first flange thickness;

connecting the first cartridge flange to the dispenser body with the plate in the first position;

removing the first cartridge flange from the dispenser body; and moving the plate toward a second position in which the dispenser body is configured to receive a second cartridge flange having a second flange thickness different than the first flange thickness.

16. The method of claim 15, further comprising:

connecting the second cartridge flange to the dispenser body with the plate in the second position.

17. The method of claim 15, wherein at least one of placing the plate in the first position or moving the plate toward the second position includes overcoming a bias force exerted in a direction toward the corresponding first cartridge flange or the second cartridge flange.

* * * * *